US009700924B2

(12) United States Patent
Kohlrausch et al.

(10) Patent No.: US 9,700,924 B2
(45) Date of Patent: Jul. 11, 2017

(54) METHOD AND DEVICE FOR ROLLING STOCK AND USE OF A COOLING LUBRICANT

(71) Applicant: SMS Siemag Aktiengesellschaft, Düsseldorf (DE)

(72) Inventors: Arnt Kohlrausch, Kreuztal (DE); Hartmut Pawelski, Ratingen (DE); Olaf Norman Jepsen, Siegen (DE)

(73) Assignee: SMS GROUP GMBH, Düsseldorf (DE)

( * ) Notice: Subject to any disclaimer, the term of this patent is extended or adjusted under 35 U.S.C. 154(b) by 0 days.

(21) Appl. No.: 14/369,444

(22) PCT Filed: Dec. 14, 2012

(86) PCT No.: PCT/EP2012/075620

§ 371 (c)(1),
(2) Date: Jun. 27, 2014

(87) PCT Pub. No.: WO2013/098098

PCT Pub. Date: Jul. 4, 2013

(65) Prior Publication Data

US 2015/0027187 A1 Jan. 29, 2015

(30) Foreign Application Priority Data

Dec. 29, 2011 (DE) ..... 10 2011 090 098

(51) Int. Cl.
*B21B 45/02* (2006.01)
*B21B 27/10* (2006.01)

(52) U.S. Cl.
CPC ..... *B21B 45/0242* (2013.01); *B21B 45/0206* (2013.01); *B21B 27/10* (2013.01); *B21B 2027/103* (2013.01)

(58) Field of Classification Search
CPC ..... B21B 45/0242; B21B 45/0248; B21B 45/0266; B21B 45/0239; B21B 45/0251; B21B 27/10; B21B 27/06; B21C 9/02; B21C 9/005
USPC ..... 72/236, 201
See application file for complete search history.

(56) References Cited

U.S. PATENT DOCUMENTS 2,914,974 A * 12/1959 Barworth et al. ..... 72/42
2,914,975 A * 12/1959 Cavanaugh et al. ..... 72/42
3,409,551 A * 11/1968 Treat ..... B21B 45/0242 508/178
4,202,193 A 5/1980 Wilson et al.
5,090,225 A 2/1992 Schimion
(Continued)

FOREIGN PATENT DOCUMENTS

CA 2343834 3/2000
CN 2788917 Y 6/2006
(Continued)

*Primary Examiner* — Edward Moran
*Assistant Examiner* — Mohammad Yusuf
(74) *Attorney, Agent, or Firm* — Lucas & Mercanti, LLP; Klaus P. Stoffel

(57) ABSTRACT

A method for rolling rolling stock, wherein a water-based cooling lubricant is applied to the rolling stock and/or to at least one roller which forms a roll gap, at least one water-soluble and tribologically active additive being added to the water-based cooling lubricant prior to application to the rolling stock and/or to the at least one roller.

20 Claims, 1 Drawing Sheet

(56) References Cited

U.S. PATENT DOCUMENTS

| | | | | |
|---|---|---|---|---|
| 5,657,655 | A * | 8/1997 | Yasuda et al. | 72/11.5 |
| 5,859,124 | A | 1/1999 | Yorifiji et al. | |
| 5,983,689 | A * | 11/1999 | Yorifuji et al. | 72/42 |
| 6,497,127 | B2 | 12/2002 | Nishiura et al. | |
| 6,651,473 | B2 | 11/2003 | Roller | |
| 7,159,433 | B2 | 1/2007 | Seidel | |
| 7,260,968 | B2 | 8/2007 | Buenten et al. | |
| 7,315,421 | B2 | 1/2008 | Fujihara et al. | |
| 7,919,438 | B2 * | 4/2011 | Rajagopalan et al. | 508/110 |
| 8,001,820 | B2 | 8/2011 | Pawelski et al. | |
| 8,356,501 | B2 | 1/2013 | Takahama et al. | |
| 8,584,499 | B2 | 11/2013 | Takahama et al. | |
| 8,720,244 | B2 | 5/2014 | Takahama et al. | |
| 2004/0217184 | A1 | 11/2004 | Seidel | |
| 2008/0006387 | A1 | 1/2008 | Welker | |
| 2008/0087066 | A1 * | 4/2008 | Takahama et al. | 72/45 |

FOREIGN PATENT DOCUMENTS

| | | | |
|---|---|---|---|
| CN | 101253007 | A | 8/2008 |
| DE | 19621837 | | 9/1997 |
| DE | 10107567 | | 8/2002 |
| DE | 10143407 | A1 | 1/2003 |
| DE | 10143407 | | 3/2003 |
| DE | 102004061939 | | 8/2006 |
| DE | 102005042020 | | 3/2007 |
| DE | 60030288 | | 10/2007 |
| EP | 0367967 | | 5/1990 |
| EP | 0682588 | B1 | 8/1997 |
| EP | 0839895 | | 5/1998 |
| EP | 0839895 | A2 | 5/1998 |
| EP | 1005925 | | 6/2000 |
| EP | 1829623 | | 9/2007 |
| EP | 1829625 | | 9/2007 |
| EP | 2314390 | | 4/2011 |
| EP | 2353741 | | 8/2011 |
| GB | 729615 | | 5/1955 |
| GB | 729615 | A | 5/1955 |
| JP | 63303615 | | 12/1988 |
| JP | H06179888 | A | 6/1994 |
| JP | 1245905 | | 2/2000 |
| JP | 2000094026 | | 4/2000 |
| JP | 2002224731 | | 8/2002 |
| JP | 2005501728 | A | 1/2005 |
| RU | 2287386 | C2 | 11/2006 |
| WO | 9417954 | | 8/1994 |
| WO | 03002277 | A1 | 1/2003 |
| WO | 2011067119 | | 6/2011 |
| WO | 2011067123 | | 6/2011 |

* cited by examiner

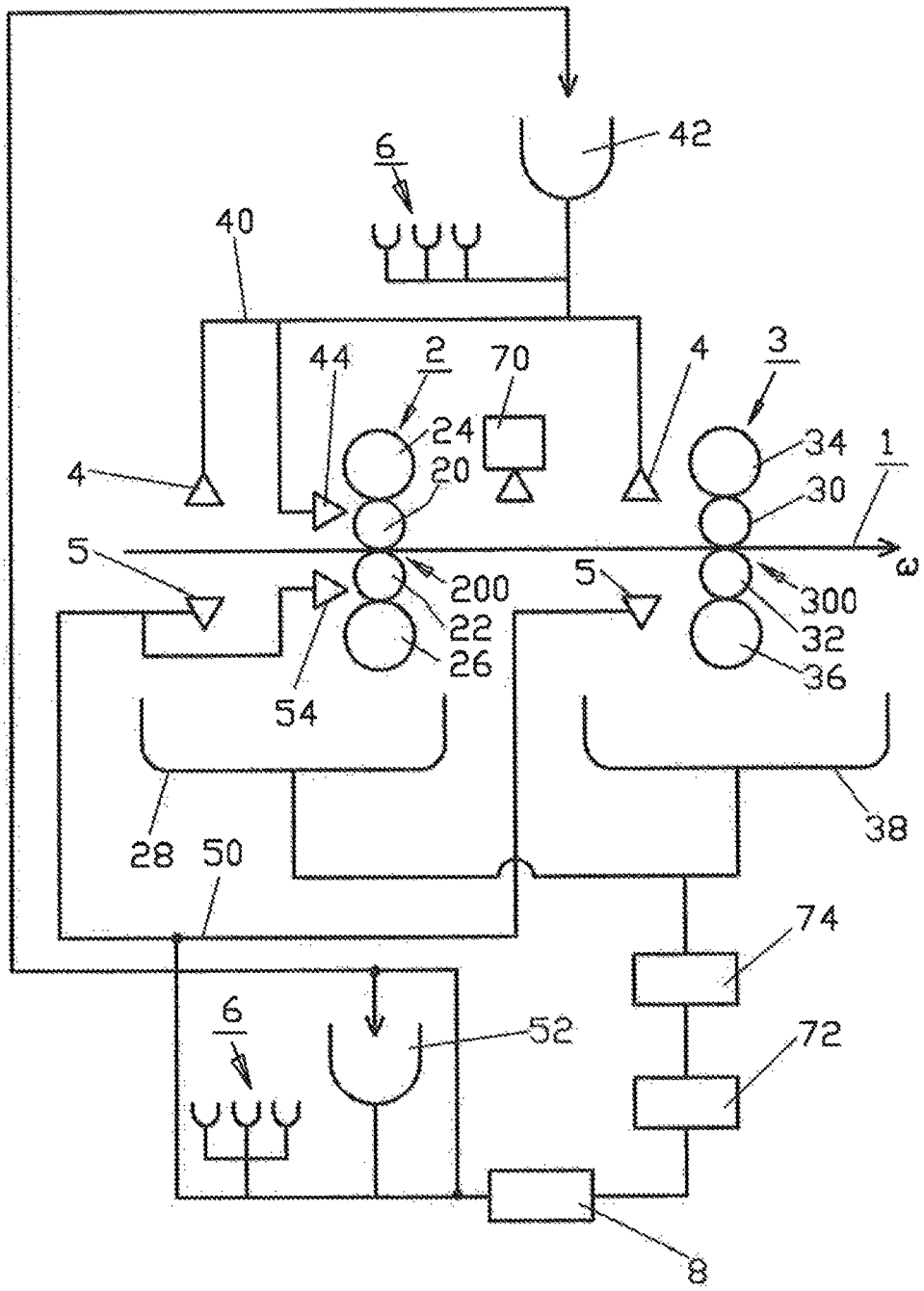
6
42
40
44
2
70
4
3
24
34
1
4
20
30
5
200
5
300
22
32
26
36
54
28
50
38
74
6
52
72
8

METHOD AND DEVICE FOR ROLLING STOCK AND USE OF A COOLING LUBRICANT

The present application is a 371 of International application PCT/EP2012/075620, filed Dec. 14, 2012, which claims priority of DE 10 2011 090 098.5, filed Dec. 29, 2011, the priority of these applications are hereby claimed and these applications are incorporated herein by reference.

BACKGROUND OF THE INVENTION

The present invention pertains to a method for rolling rolling stock, to a device for rolling such stock, and to the use of a cooling lubricant for rolling such stock. The method, the device, and the use are preferably used for cold-rolling.

PRIOR ART

In the cold-rolling and hot-rolling of metal strip, fluids are usually applied to the rolls and/or to the rolling stock to cool the rolls and the strip, to lubricate the action surfaces, and to make it possible to clean the rolls and the strip. These fluids are usually called "cooling lubricants".

With respect to the cooling function for rolls and strip, the cooling lubricants carry away the heat of deformation and the heat of friction, especially during cold-rolling. With respect to the function of lubricating the action surface in the roll gap, the cooling lubricants serve to produce suitable tribological conditions in the roll gap and thus to ensure that the surface of the rolled stock has the desired quality. With respect to the cleaning function, the cooling lubricants serve to clean the rolls and the rolling stock, to carry away dirt particles, and thus to ensure good surface quality of the rolled strip.

Cooling lubricants, furthermore, can have an influence on the conditioning of the strip. Cooling lubricants are also formulated in such a way that they are compatible with the upstream and downstream machines within the process chain involved in the processing of the s rolling stock, this compatibility pertaining to, for example, corrosion protection, the cleaning carried out in other process steps, and/or the avoidance of discoloration of the rolled strip during the annealing of the rolling stock, for example. It is also desirable for the properties of the cooling lubricant to remain essentially stable during use and for no degradation to occur over the course of time.

A list of requirements for cooling lubricants is thus obtained: namely, they must have a high heat capacity and good heat transfer behavior; they must make it possible, by adaptation of the viscosity of the cooling lubricant to the process in question, for the amount of in-drawn lubricating film to be sufficient to achieve a state of mixed friction; they must make it possible for a state of boundary friction adapted to the process in question to develop; and they must offer a good washing effect and be easy to filter at the same time.

The last aspect in particular is important, because circulating systems for the use of cooling lubricants are usually used, and the dirt particles which are being carried away must be removed from the cooling lubricant circuit in order to ensure the good surface quality of the rolled strip and to make it possible to recycle the previously used cooling lubricant.

The cooling lubricants usually used according to the prior art in the industrial practice of cold rolling are either single-phase, oil-based cooling lubricants or in the form of water-based cooling lubricants with dispersed oil-based droplets and therefore in the form of emulsions.

The purely oil-based cooling lubricants suffer from the disadvantage versus water-based systems that they are combustible, are less effective at transferring heat, and have a low heat capacity. The productivity of rolling mills operated with such lubricants is thus comparatively limited.

Emulsions can suffer from disadvantages as well, namely, that the oil-based droplets within the emulsion must first settle on the rolled surfaces or surfaces of the rolling stock, so that the active lubricating substances in them and the higher viscosity of the oil phase can perform their function. Before the lubricant is drawn into the action surface of the roll gap, it is therefore desirable for the continuous phase to separate from the tribologically active substance. This leads to a delay in the action, as a result of which either a limit is imposed on the rolling speed, or the distances between the rolling stands must be increased to provide the required action time.

Another disadvantage of emulsions is that it is not possible to filter out ultrafine particles from them to a sufficient degree.

In the following, the terms "ultrafine filtration and "ultrafine filtering" are used to indicate that, in contrast to "filtration" and "fine filtration", the process in question also includes the section of the particle spectrum in which the largest lengthwise dimension of a single particle is less than 5 μm.

Dirt particles which are smaller than or equal to the size of the oil droplets in the emulsion cannot be removed from the cooling lubricant without the oil phase being taken out of the cooling lubricant simultaneously. The properties of the water-based cooling lubricants with dispersed oil-based droplets can also be degraded by mechanical, biological, or chemical effects.

In the following, the term "degradation" is used for the sake of simplicity to designate a disadvantageous change in a product property, no attempt being made to give a detailed description of the associated mechanism on which the change is based or to give any limiting references to a system of scientific classification with respect to the physical, chemical, process-technological, physiological, olfactory, or any other type of product property.

SUMMARY OF THE INVENTION

Based on this prior art, the goal of the present invention is to provide a method for rolling rolling stock which minimizes the disadvantages of the prior art described above.

This goal is achieved by the method of the present invention. This method is characterized in that the excess cooling lubricant is subjected to an ultrafine filtration after it has been collected but before it is reapplied.

Thus a method for rolling rolling stock is proposed, wherein a water-based cooling lubricant is applied to the rolling stock and/or to at least one of the rolls forming the roll gap. According to the invention, a water-soluble additive serving to change the viscosity and the lubricating properties in the action surface during the forming process is added to the water-based cooling lubricant before the lubricant is applied to the stock and/or to the at least one roll; in the following, this additive is called merely a "tribologically active additive".

The addition of a water-soluble, tribologically active additive to the water-based cooling lubricant makes it possible to implement ultrafine filtration; the possibility of ultrafine filtration means that the excess cooling lubricant can be filtered without the loss of tribological effectiveness. The excess cooling lubricant can therefore be reused, i.e., returned to the cooling lubricant circuit. As a result of the ultrafine filtration, it is also possible simultaneously to obtain rolled stock of high surface quality, because the material abraded from the rolls is suitably removed and discharged from the cooling lubricant circuit.

Because of the high water content of the cooling lubricant, the danger of fire is significantly lower than that for cooling lubricants based on oils or oil-containing emulsions. Through the use of the water-soluble, tribologically active additive, furthermore, it is achieved that the active lubricating effect of the corresponding cooling lubricant . . . a comparatively short time after the lubricant is applied to the roll surface or to the surface of the rolling stock, there being no need to wait for the phase separation which must occur in the case of emulsions or dispersions prior to arrival of the lubricant at the action surface of the forming process.

The use of the water-soluble, tribologically active additive also offers the advantage over the use of oil-based cooling lubricants that, in certain applications such as the high-speed rolling of aluminum, it is possible to use viscosity ranges which are not available with oil-based cooling lubricants or which are not practical under industrial manufacturing conditions. This pertains in particular to substances with a kinematic viscosity of less than 1.8 $mm^2/s$ at 40° C.

Through a suitable selection of the water-soluble, tribologically active additive, the cooling lubricant can be adapted to suit the individual rolling situation; for example, it can be adapted to the processed stock or material to be rolled and to the rolling conditions in the roll gap.

Through the targeted selection of the water-soluble, tribologically active additive, furthermore, it is also possible to adjust the tribological conditions in the roll gap as a function of the specific rolling situation in an effective manner.

The water-based cooling lubricant together with the water-soluble, tribologically active additive is preferably applied to the rolling stock and/or to the rolls forming the roll gap as a function of the specific rolling situation, preferably by adjustment of the application conditions, especially preferably by variation of the entrance temperature, the application pressure, the way in which the lubricant is applied, and the place where it is applied. Correspondingly, a certain concentration or layer thickness of the water-soluble, tribologically active additive is achieved on the stock and/or on the corresponding roll(s) in order to arrive at the desired tribological relationships in the roll gap.

To design an effective cooling lubricant circuit, excess cooling lubricant is collected after it has been applied to the rolling stock and/or the roll; it is then subjected to ultrafine filtration; and finally the ultrafinely filtered cooling lubricant is used again as a cooling lubricant for application to the stock and/or to the roll. As a result of the ultrafine filtration, the material abraded from the rolls and other foreign materials are removed from the cooling lubricant, and the cooling lubricant can then be recycled without loss of quality. Thus efficient use can be made of the cooling lubricant.

In this context, it is especially preferable to supply at least one water-soluble, tribologically active additive to the ultrafinely filtered cooling lubricant to restore the originally desired additive concentration in the cooling lubricant before it is reapplied to the rolling stock and/or to the roll. This is preferably done on the basis of a determination of the degree to which this additive has become depleted or has accumulated, wherein the degree of depletion is preferably determined by a continuous measurement of the relative permittivity and/or of the specific electrical conductivity of the collected cooling lubricant.

In a preferred embodiment, the accumulation of the additive on the rolling stock and/or on the at least one roll is determined by evaluation of the measured rolling process data under inclusion of a suitable tribological process model, and the addition of the water-soluble, tribologically active additive is controlled in such a way that the desired additive accumulation is achieved. Thus the necessary concentration of the additive in the cooling lubricant can be determined, and the water-soluble, tribologically active additive can be added to the cooling lubricant stream accordingly.

The degree to which the additive has accumulated on the stock leaving the roll gap is determined on the basis of the additive layer remaining on the stock, and the addition of the water-soluble, tribologically active additive is controlled in a closed-loop or open-loop manner as appropriate, so that the desired degree of remaining additive accumulation is achieved.

In a further embodiment of the method, the addition of the water-soluble, tribologically active additive is conducted on the basis of a continuous measurement of the abraded roll particles in the collected cooling lubricant. This is preferably done continuously and on-line in the form of particle measurements and classification into size classes relevant to the rolling process, the evaluation being done by comparison with a database containing data on the roll material, the roughness of the roll, the type of roll, the stock being rolled, the alloy, the reduction-per-pass plan, and a suitable process model, whereupon the composition of the cooling lubricant is controlled accordingly in an open-loop or closed-loop manner.

In another advantageous embodiment, at least one additional water-soluble additive is metered into the cooling lubricant, preferably to balance the effect of the cooling lubricant between a washing action and a lubricating action, preferably as a function of the desired surface appearance and the appearance actually obtained as determined by, for example, the degree of gloss, roughness, ghosting, or texture. The concentration of a specific water-soluble additive is determined essentially continuously, preferably by way of spectrometry and/or the continuous measurement of the relative permittivity and/or specific electrical conductivity of the cooling lubricant.

In another embodiment of the method, the amount of water-soluble, tribologically active additive added to the cooling lubricant applied to the top of the rolling stock and/or to the upper roll is different from the amount added to the cooling lubricant applied to the bottom of the stock and/or to the lower roll. In this way, the surfaces of the rolled stock acquire different appearances, which means that the top can be given properties different from those of the bottom and thus can be given a different appearance.

In another elaboration, the amount of water-soluble, tribologically active additive added is varied over the course of time. Thus, so-called "tailored blanks" can be produced, in the case of which different material properties and in particular different surface finishes are achieved within a single, continuously rolled piece of stock.

The goal described above is also achieved by a device of the present invention.

In a corresponding manner, a device for rolling strip stock in a roll gap formed by rolls is proposed, wherein a water-based cooling lubricant is applied to the stock and/or to at least one of the rolls forming the roll gap. According to the invention, a water-soluble, tribologically active additive is added to the water-based cooling lubricant.

The goal described above is also achieved by use of a water-based cooling lubricant during the rolling of rolling stock, preferably during the cold-rolling of rolling stock. According to the invention, at least one water-soluble, tribologically active additive is added to the water-based cooling lubricant.

BRIEF DESCRIPTION OF THE DRAWING

Preferred additional embodiments and aspects of the present invention are explained in greater detail by the following description of the FIGURE:

FIG. 1 shows a schematic diagram of a cold-rolling mill from the side.

DETAILED DESCRIPTION OF THE INVENTION

In the following, preferred exemplary embodiments are described on the basis of the figures. The same or similar elements or elements which function in the same way are designated by the same reference numbers, and in some cases these elements are not described again in order to avoid redundancy in the description.

The rolling stock 1 passes through two schematically illustrated rolling stands 2, 3, each of which comprises an upper roll 20, 30 and a lower roll 22, 32, each of which is supported by a back-up roll 24, 34, 26, 36. Between the upper and lower rolls 20, 22, 30, 32, the roll gap 200, 300 itself is formed, where the rolling stock 1 is formed.

The illustrated design of the rolling stands and the arrangement of the rolls is to be understood as being merely schematic, and any other arrangement of rolls of the individual rolling stands suitable for the rolling situation in question is also possible.

The rolling stand 2 coming first in the rolling direction thus performs the first pass, whereupon the following rolling stands 3, etc., perform the subsequent passes.

The cooling lubricant is applied to the rolling stock 1 before it enters the roll gap 200, 300 of the rolling stand 2, 3 in question. The cooling lubricant is applied to the rolling stock 1 in each case by means of spray bars 4, which extend transversely across the rolling stock 1, onto the top surface of the rolling stock 1. The individual spray bars 4 are supplied with the cooling lubricant through feed lines 40 for the cooling lubricant proceeding from a cooling lubricant reservoir 42.

In a lower area underneath the stock 1, spray bars 5 are also provided, which are also supplied through feed lines 50 for the cooling lubricant proceeding from a cooling lubricant reservoir 52 and which are designed to apply the cooling lubricant to the rolling stock 1.

The cooling lubricant can also be applied directly to the rolls 20, 22 which come in contact with the rolling stock 1. A corresponding device for this purpose is indicated schematically in FIG. 1 in the form of the spray bars 44, 54, which are arranged appropriately in front of the roll gap 200, extending across the rolls 20, 22.

Underneath the rolling stands 2, 3 and/or underneath the spray bars 4, 44, 5, 54, collecting tanks 28, 38 can be provided, which collect the excess cooling lubricant dripping back down from the rolling stock 1 and/or from the rolls 20, 22. By means of the collecting tanks 28, 38, it is possible to collect the excess cooling lubricant again and then to return it to the cooling lubricant circuit. In this way, the cooling lubricant can be recycled, and thus the rolling process can be conducted more efficiently.

In FIG. 1, the supply of cooling lubricant to the upper cooling bar 4 is separate from the supply to the lower cooling bar 5, so that it is possible to apply the cooling lubricant in an asymmetric manner, meaning that it is possible to obtain a rolled strip 1 with a surface appearance on the top different from that on the bottom.

Water-soluble, tribologically active additives of different properties, as shown schematically by the metering device 6, can be added in variable amounts to the cooling lubricant.

The metering device 6 for adding water-soluble additives to the cooling lubricant, which is applied via the cooling bars 4, 5, makes it possible to make precise adjustments to the properties of the cooling lubricant which is applied to the rolling stock 1 and/or to the rolls coming in contact with the stock.

For example, the desired tribological properties in the roll gap can be achieved by means of a carefully calibrated addition of water-soluble, tribologically active additives to the water-based cooling lubricant. Through appropriate adjustment of the addition of the water-soluble, tribologically active additives, furthermore, it is possible, for example, to achieve a balance between a desired washing effect and a desired lubricating effect of the cooling lubricant, depending on the desired surface appearance and on the desired thickness reduction to be obtained during the production of the rolled strip from the rolling stock 1.

In addition, the rolling process data originating from the monitoring and analysis of the roll gap under inclusion of a suitable tribological process model can be used to control the composition of the additives in the cooling lubricant.

By the use of sensors 70, indicated here schematically, the additive accumulation present on the strip rolled from the rolling stock 1 behind the roll gap 200 can be measured after the rolling strip has passed through the roll gap 200. This parameter, too, can be taken into account when adjusting the addition of the water-soluble, tribologically active additives. In corresponding fashion, the mixture of the water-soluble, tribologically active additives in question is adjusted by the metering device 6.

By means of electrical conductivity sensors or sensors which measure the relative permittivity of the cooling lubricant, such as by means of the sensor 72, indicated schematically by way of example, the depletion of individual additives in the cooling lubricant circuit can be determined, and an addition of the depleted water-soluble additive can be actuated correspondingly.

In another advantageous embodiment, the abraded roll particles can be measured by the sensor 74, also indicated schematically, and the rolling process can be monitored by means of a particle measurement under comparative use of a database containing data on the roll material, the roll surface, the rolling stock being rolled, the alloy, the rolling conditions, and a suitable process model, on the basis of which a corresponding characteristic abrasion diagram can be created. The metered addition of the water-soluble additive by means of the metering device 6 can thus also be controlled in this way.

The return stream of circulating cooling lubricant via the two collecting tanks 28, 38, shown schematically by way of example, passes first through the corresponding sensors 72, 74 and is then subjected to ultrafine filtration in the filter 8. The filtering device 8 which is used preferably provides an ultrafine filtration of such a kind that even particles with a size of less than 5 μm are removed from the collected lubricant, so that the lubricant can be added back to the circuit of the cooling lubricant without loss of quality with respect to the forming of the rolling stock 1.

Because one spray bar 4 is arranged above the strip and another spray bar 5 is arranged below it, it is possible to spray the additive asymmetrically onto the top and bottom of the strip 1, as a result of which different surface appearances can be produced.

The provision of the metering device 6 also makes it possible to apply the water-soluble, tribologically active additive selectively and in time-variable fashion to the rolling stock. Thus a flexible rolling schedule can be followed, and customized products with variable properties of the rolling stock with respect to width, length, and time can be manufactured. For example, it is possible in this way to vary the thickness of the strip, its surface appearance, roughness, wettability, and coatability.

The cooling lubricants which are used are formulated accordingly as water-based cooling lubricants, which, by means of water-based additives comprising viscosity increasers in particular, which provide for adequate hydrodynamic lubricating film formation, good cooling properties, and the necessary ultrafine filterability even in the range of less than 5 μm, and simultaneously guarantee stability against the biodegradation of the cooling lubricant. The tribological conditions in the roll gap appropriate to the corresponding rolling task can thus be achieved through the addition of the water-soluble, tribologically active additives to the water-based cooling lubricant.

The viscosity can be adjusted by the use of viscosity increasers, the addition of which is adjusted to fall within a range suitable for typical rolling jobs. This measure also offers the advantage over the use of rolling oils that the high viscosities required for certain applications such as the high-speed rolling of aluminum can be achieved, which is impossible with the use of the cooling lubricants in conventional use today.

The interface friction in the roll gap is achieved by the accumulation of special water-soluble, tribologically active additives (selected for their suitability for the forming process by the rolls) on the roll surface and/or on the rolling stock, especially on the strip 1. In corresponding fashion, the water-soluble, tribologically active additives are adjusted to suit the rolling job, that is, in particular to suit the material and the rolling conditions in the roll gap; and the additive accumulation on the rolls, the roll surfaces, and the strip can be varied by adjusting and/or changing of the associated application conditions, such as by changing or adjusting the entrance temperature, the application pressure, and the manner in which, and the location where, the cooling lubricant is applied.

Water-based cooling lubricants with viscosity increasers are known from, for example, the area of metal machining.

Insofar as applicable, all individual features which are described in the individual exemplary embodiments can be combined with each other and/or exchanged without exceeding the scope of the invention.

LIST OF REFERENCE NUMBERS

1 rolling stock
2 rolling stand
20 upper roll
22 lower roll
24, 26 back-up rolls
28 collecting tank for excess cooling lubricant
200 roll gap
3 rolling stand
30 upper roll
32 lower roll
34, 36 back-up rolls
38 collecting tank for excess cooling lubricant
300 roll gap
4 upper spray bar for the rolling stock
40 feed line for cooling lubricant
42 upper cooling lubricant reservoir
44 spray bar for the upper roll
5 lower spray bar for the rolling stock
50 feed line for cooling lubricant
52 lower cooling lubricant reservoir
54 spray bar for the lower roll
6 metering device for one or more water-soluble, tribologically active additives
70 sensor for additive accumulation
72 sensor for measuring electrical conductivity
74 sensor for abraded roll particles
8 filter device
W rolling direction

The invention claimed is:

1. A method for rolling of rolling stock (1), comprising the steps of: applying a water-based cooling lubricant to the rolling stock (1) and/or to at least one roll of a pair of rolls (20, 22, 30, 32) forming a roll gap (200, 300); adding at least one water-soluble, tribologically active additive to the water-based cooling lubricant before the water-based cooling lubricant is applied to the rolling stock and/or to the at least one roll; collecting excess cooling lubricant after application to the rolling stock (1) and/or to the at least one roll (20, 22, 30, 32) whereupon the excess cooling lubricant is used again for application to the rolling stock (1) and/or to the at least one roll (20, 22, 30, 32); continuously filtering the excess cooling lubricant after the excess cooling lubricant has been applied but before the excess cooling lubricant is reapplied so as to filter material abraded from the rolls in a section of a particle spectrum in which a largest lengthwise dimension of a single particle is less than 5 μm; determining with a sensor an accumulation of the water-soluble additive on the rolling stock (1) and/or on the at least one roll (20, 22, 30, 32) resulting from evaporation of a portion of the water-based lubricant; and adding additional of the water-soluble additive to the filtered excess-cooling lubricant based on the accumulation of the water-soluble additive on the rolling stock and/or on the at least one roll before the excess-cooling lubricant is used again for application to the rolling stock and/or to the at least-one roll.

2. A method according to claim 1, wherein the at least one water-soluble, tribologically active additive is selected to suit an individual rolling situation.

3. A method according to claim 1, wherein the water-based cooling lubricant together with the water-soluble, tribologically active additive is applied to the rolling stock (1) and/or to the rolls (20, 22, 30, 32) forming the roll gap (200, 300) as a function of a rolling situation.

4. A method according to claim 1, wherein, before the filtered cooling lubricant is applied again to the rolling stock (1) and/or to the roll (20, 33, 30, 32), the at least one water-soluble, tribologically active additive is re-added to reestablish a desired additive concentration in the cooling lubricant.

5. A method according to claim 1, wherein the accumulation of the additive on the rolling stock (1) and/or on the at least one roll (20, 22, 30, 32) is determined via an evaluation of measured rolling process data under inclusion of a suitable tribological rolling gap model, and the addition of the water-soluble, tribologically active additive is controlled so that a desired additive accumulation is achieved.

6. A method according to claim 1, wherein an additive accumulation on the rolling stock (1) leaving the roll gap (200, 300) is determined based on an additive layer remaining on the rolling stock (1), and the addition of the water-soluble, tribologically active additive is controlled accordingly in an open-loop or closed-loop manner.

7. A method according to claim 1, wherein a metered addition of the water-soluble, tribologically active additive is controlled in an open-loop or closed-loop manner based on a continuous measurement of abraded roll particles in the collected cooling lubricant.

8. A method according to claim 1, wherein an amount of water-soluble, tribologically active additive added to the cooling lubricant applied to a top of the rolling stock (1) and/or to an upper roll (20) is different from an amount added to the cooling lubricant applied to a bottom of the rolling stock (1) and/or to a lower roll (22).

9. A method according to claim 1, wherein an amount of water-soluble, tribologically active additive added is varied over time.

10. A method according to claim 1, wherein at least one additional water-soluble additive is metered into the cooling lubricant.

11. A device for rolling of rolling stock (1), comprising: rolls (20, 22, 30, 32) that form a roll gap (200, 300); apparatus arranged to apply a water-based cooling lubricant to the rolling stock (1) and/or to at least one of the rolls (20, 22, 30, 32) forming the roll gap a device for adding a water-soluble, tribologically active additive to the water-based cooling lubricant; at least one filter device (8) for continuous filtration of collected cooling lubricant, the filter device being configured to filter material abraded from the rolls in a section of a particle spectrum in which a largest lengthwise dimension of a single particle is less than 5 μm; and, a device arranged to determine an accumulation of the water-soluble additive on the rolling stock and/or on at least one of the rolls resulting from evaporation of a portion of the water-based lubricant; wherein the device for adding the water-soluble additive adds additional of the water-soluble additive to the filtered excess-cooling lubricant based on the accumulation of the water-soluble additive on the rolling stock and/or on the at least one roll before the excess-cooling lubricant is used again for application to the rolling stock and/or to the at least one roll.

12. A device according to claim 11, further comprising a metering device (6) for adding the water-soluble, tribologically active additive to the cooling lubricant under open-loop or closed-loop control.

13. A method according to claim 2, wherein the additive is selected to suit a material of the rolling stock and/or desired tribological conditions in the roll gap.

14. A method according to claim 3, wherein the water-based cooling lubricant together with the water-soluble, tribologically active additive is applied by adjusting application conditions.

15. A method according to claim 14, wherein the water-based cooling lubricant together with the water-soluble, tribologically active additive is applied by changing entrance temperature, application pressure, manner of application, and location of application.

16. A method according to claim 4, wherein the at least one water-soluble, tribologically active additive is re-added based on a determination of a depletion of the additive.

17. A method according to claim 16, wherein the depletion is determined by a continuous measurement of relative permittivity and/or specific electrical conductivity of the cooling lubricant.

18. A method according to claim 7, wherein the metered addition of the water-soluble, tribologically active additive is controlled using a database for comparison, which database contains data on the roll material, roughness of the rolls, type of roll, the rolling stock, an alloy, a reduction-per-pass plan, and a suitable tribological process model.

19. A method according to claim 10, wherein the at least one additional water-soluble additive is metered into the cooling lubricant to balance an action of the cooling lubricant between a washing effect and a lubricating effect.

20. A method according to claim 10, wherein the at least one additional water-soluble additive is metered into the cooling lubricant as a function of a desired surface appearance.

* * * * *